US010753054B2

(12) United States Patent
Davey

(10) Patent No.: US 10,753,054 B2
(45) Date of Patent: Aug. 25, 2020

(54) ANCHOR SYSTEM FOR POLE MARKER

(71) Applicant: Theodore Eugene Davey, Norwalk, CT (US)

(72) Inventor: Theodore Eugene Davey, Norwalk, CT (US)

( * ) Notice: Subject to any disclaimer, the term of this patent is extended or adjusted under 35 U.S.C. 154(b) by 0 days.

(21) Appl. No.: 16/150,903

(22) Filed: Oct. 3, 2018

(65) Prior Publication Data

US 2019/0119870 A1 Apr. 25, 2019

Related U.S. Application Data

(60) Provisional application No. 62/665,767, filed on May 2, 2018, provisional application No. 62/575,805, filed on Oct. 23, 2017.

(51) Int. Cl.

| | |
|---|---|
| ***E01F 9/677*** | (2016.01) |
| ***E04H 12/22*** | (2006.01) |
| ***E01F 9/608*** | (2016.01) |
| ***E01F 9/619*** | (2016.01) |
| *E04H 17/22* | (2006.01) |
| *E04H 15/62* | (2006.01) |
| *E04H 17/08* | (2006.01) |

(52) U.S. Cl.

CPC ..... *E01F 9/677* (2016.02); *E01F 9/608* (2016.02); *E01F 9/619* (2016.02); *E04H 12/223* (2013.01); *E04H 12/2215* (2013.01); *E04H 12/2292* (2013.01); *E04H 15/62* (2013.01); *E04H 17/08* (2013.01); *E04H 17/22* (2013.01)

(58) Field of Classification Search

CPC ..... E04H 12/2215; E04H 15/62; E04H 12/32; E04H 12/2292; E04H 12/223; E04H 12/2269; A45F 3/44; A01K 97/10; E01F 9/608; E01F 9/65; E01F 9/658; E01F 9/685; E01F 9/629; E01F 9/662; E01F 9/619; E01F 9/677; G09F 7/18; A01G 17/04; A01G 9/122

USPC ..... 248/530, 545; 40/607.06, 607.05

See application file for complete search history.

(56) References Cited

U.S. PATENT DOCUMENTS

| | | | | | |
|---|---|---|---|---|---|
| 539,411 | A * | 5/1895 | Brown | E04B 1/34347 | 52/149 |
| 1,764,284 | A * | 6/1930 | Barton | E04H 17/00 | 256/1 |
| 2,651,502 | A * | 9/1953 | Carvelo | E04H 17/18 | 256/33 |
| 2,779,240 | A * | 1/1957 | Gaydos | E01F 9/608 | 359/514 |
| 2,926,874 | A * | 3/1960 | Hahn | A01K 97/10 | 248/299.1 |

(Continued)

*Primary Examiner* — Hiwot E Tefera
*Assistant Examiner* — Taylor L Morris
(74) *Attorney, Agent, or Firm* — Welsh IP Law LLC

(57) ABSTRACT

A support for positioning a marking pole relative to a driving surface and a method of using the same is disclosed. The support includes a shaft member extending between a first end and a second end and an intermediate portion between the first end and the second end. A first anchor extends from the second end of the shaft member. A second anchor extends from an area of the shaft member between first end and the second end of the shaft member. The shaft member defines a cantilevered section between the first end and the intersection of anchor. A receiver is at the first end of the shaft and configured to receive a marking pole.

6 Claims, 5 Drawing Sheets

(56) References Cited

U.S. PATENT DOCUMENTS 3,612,455 A * 10/1971 Cole ..... A01K 97/10 248/530
4,296,584 A * 10/1981 Lempa, Jr. ..... E04H 12/2292 52/169.13
4,343,449 A * 8/1982 Osthus ..... E04H 12/2215 248/121
4,402,166 A * 9/1983 Wortham, Jr. ..... E04H 12/223 248/156
D292,475 S * 10/1987 Kitchen ..... D8/1
4,832,338 A * 5/1989 Magazzi ..... A63B 55/10 248/530
4,922,653 A * 5/1990 Stone ..... A01G 17/04 47/45
5,044,200 A * 9/1991 Dailey ..... G01F 19/00 116/227
5,263,279 A * 11/1993 Delsanne ..... A01G 9/124 248/530
5,375,801 A * 12/1994 Porter ..... E04H 12/2215 248/156
5,460,344 A * 10/1995 Malloy ..... E04H 12/2215 156/63
5,533,295 A * 7/1996 Hochberger ..... A01K 97/10 248/512
5,817,247 A * 10/1998 Colatruglio ..... E01C 19/502 249/4
5,848,502 A * 12/1998 Schaefer ..... E04H 12/2215 52/165
5,984,587 A * 11/1999 Odle ..... E01F 9/685 248/530
6,141,903 A * 11/2000 Mancini ..... A01G 17/04 248/351
6,145,528 A * 11/2000 Egnew ..... E04H 12/2215 135/114
6,227,845 B1 * 5/2001 Pillow ..... F21L 17/00 248/156
6,230,451 B1 * 5/2001 Stoller ..... A63C 19/10 220/9.4
6,273,391 B1 * 8/2001 Engolia ..... A01K 97/10 224/422
6,371,139 B1 * 4/2002 Simchori ..... E04H 12/2223 135/16
6,490,823 B1 * 12/2002 Ibarra ..... A01K 97/10 248/512
6,575,417 B1 * 6/2003 Krommenakker ..... A47G 23/0225 248/151
6,588,723 B1 * 7/2003 Moran, III ..... A01K 39/00 248/156
6,807,924 B1 * 10/2004 Christiansen ..... G09F 17/00 116/174
6,823,814 B2 * 11/2004 Bukky ..... G09F 3/12 116/202
6,938,370 B2 * 9/2005 Johns ..... A01G 9/122 248/156
7,017,299 B1 * 3/2006 Speed ..... A01G 9/12 47/21.1
7,020,998 B1 * 4/2006 Kirkland ..... A01G 9/124 47/42
7,216,854 B2 * 5/2007 Bryan ..... E04H 17/1443 256/22
D554,478 S * 11/2007 Robinson ..... D8/356
7,547,104 B1 * 6/2009 Nadonley ..... E01F 9/619 359/515
7,644,927 B2 * 1/2010 Law ..... F41J 1/10 248/215
7,735,259 B2 * 6/2010 Rich ..... A01G 9/122 47/44
7,854,424 B1 * 12/2010 Cook ..... A01G 9/28 256/24
8,006,434 B2 * 8/2011 Allsop ..... A01G 9/12 47/47
8,191,562 B1 * 6/2012 Sampson ..... A45B 19/04 135/118
8,640,398 B1 * 2/2014 Richmond ..... A01K 3/00 256/1
8,656,651 B1 * 2/2014 Scarano, Jr. ..... E04H 12/2223 52/157
8,978,676 B2 * 3/2015 Williams ..... E04H 12/2238 135/16
9,016,656 B2 * 4/2015 Basconi ..... E04H 17/08 248/528
9,133,594 B2 * 9/2015 Hurley ..... E02D 5/80
9,390,640 B1 * 7/2016 Coleman ..... E04H 12/2215
9,447,599 B1 * 9/2016 Parent ..... E04H 12/2223
2002/0166280 A1 * 11/2002 O'Grady, Sr. ..... A01K 97/10 43/21.2
2002/0190248 A1 * 12/2002 Ohai ..... A01K 3/00 256/64
2003/0132362 A1 * 7/2003 Miller ..... A01G 29/00 248/530
2007/0267616 A1 * 11/2007 Langenwalter ..... E04H 12/2215 256/21
2008/0006808 A1 * 1/2008 Thompson ..... E04H 17/003 256/45
2009/0302290 A1 * 12/2009 Appelman ..... A47F 10/00 256/64
2011/0024581 A1 * 2/2011 Giagni, Sr. ..... A45F 3/44 248/121
2012/0187359 A1 * 7/2012 Carmichael ..... E04H 17/063 256/59
2013/0105752 A1 * 5/2013 McCue ..... E04H 17/14 256/1
2013/0185994 A1 * 7/2013 Torok ..... A01G 9/122 47/47
2014/0041267 A1 * 2/2014 Diercks ..... F41J 1/10 40/607.05
2014/0224956 A1 * 8/2014 Tillery ..... E04H 12/2269 248/618
2015/0021532 A1 * 1/2015 Smith ..... E04H 17/20 256/19
2015/0197958 A1 * 7/2015 Wilson ..... E01F 7/025 256/10
2016/0003409 A1 * 1/2016 Johns ..... A01K 3/00 248/218.4
2017/0247910 A1 * 8/2017 Nelson ..... A01K 3/00

* cited by examiner

ANCHOR SYSTEM FOR POLE MARKER

TECHNICAL FIELD

The present invention relates to an anchor system for fixing the position of a marking pole. More specifically, the present invention relates to an anchor support for fixing a reflector marking pole relative to an edge of a driving surface.

BACKGROUND

Markers or marking poles are commonly used to identify a periphery or edge of a driving surface so that the edge of the surface is visible to an operator of a vehicle using the driving surface. The driving surface may include, for example, a public road, a private road, or a driveway. Markers are useful, for example, during the winter season when precipitation in the form of snow, ice, and or sleet and accumulates on the ground thereby obscuring the edge of the driving surface. In these conditions, it is easy for an operator to drive off the driving surface. Pole markers are also useful for identifying the edge of the driving surface at night. Pole markers are also useful for identifying the transition between a driving surface and a non-driving surface in hard to see conditions. For example, when leaves or other debris cover the surface.

Snow and other precipitation is commonly removed from a driving surface by a plow fixed on the front of a heavy vehicle such as a truck or a tractor. A blade of the plow is placed on or proximate to the driving surface. The plow is moved forward along the driving surface thereby removing snow accumulated on the driving surface.

A disadvantage of using a plow to remove snow is that the plow will damage or remove curbs and other features at on the edge of the driving surface, such as Belgian block or formed asphalt curbs. Typically, these features are covered by the snow and are not visible to the operator of the plow.

A disadvantage of known markers, however, is that they are positioned by inserting one end of the marking pole into the ground adjacent to the asphalt surface. In the case of the curb, Belgian block or the like, the marker can only be positioned outside the rigid edge material and is thus offset from the true edge of the driving surface. As a result, a plow operator relying on the markers positioned outside of the curb may inadvertently plow into the curb resulting in costly damage.

What is needed therefore is a device and method to securely fix the marker so as to more accurately identify the edge of a driving surface for a pedestrian or vehicle operator.

SUMMARY

The present invention resides in one aspect in a support for positioning a marking pole relative to a driving surface. The support includes a shaft member extending between a first end and a second end and having an intermediate portion between the first end and the second end. A first anchor extends from an area of the shaft member at or proximate to the second end of the shaft member. A second anchor extends from an area of the shaft member between first end and the second end of the shaft member. The shaft member defines a cantilevered section between the first end of the shaft member and the intersection of the second anchor and shaft member. A receiver is at the first end of the shaft. The receiver is configured to receive a marking pole.

In yet a further embodiment of the present invention the shaft member is rigid.

In yet a further embodiment of the present invention the first anchor extends radially from an axis of the first shaft member.

In yet a further embodiment of the present invention the second anchor extends radially from the axis of the shaft member.

In yet a further embodiment of the present invention the first anchor and the second anchor are parallel.

In yet a further embodiment of the present invention the first anchor and the second anchor are perpendicular to the axis of the shaft member.

In yet a further embodiment of the present invention the receiver comprises a first opening and a second opening.

In yet a further embodiment of the present invention the receiver further comprises a spacing element separating the first opening and the second opening.

In yet a further embodiment of the present invention the first opening and the second opening are coaxial.

In yet a further embodiment of the present invention a marking pole is received in the receiver.

In yet a further embodiment of the present invention the first opening and the second opening are configured such that when a marking pole is receiving therethrough the marking pole is substantially parallel the first anchor and the second anchor.

In yet a further embodiment of the present invention a distal end of the first anchor and a distal end of the second anchor each forms a point.

In yet a further embodiment of the present invention the receiver comprises a bore configured to receive a marking pole and a screw configured to fix the pole in the bore.

In yet a further embodiment of the present invention the marking pole further comprises a reflector affixed thereto.

DETAILED DESCRIPTION

Figure 1:
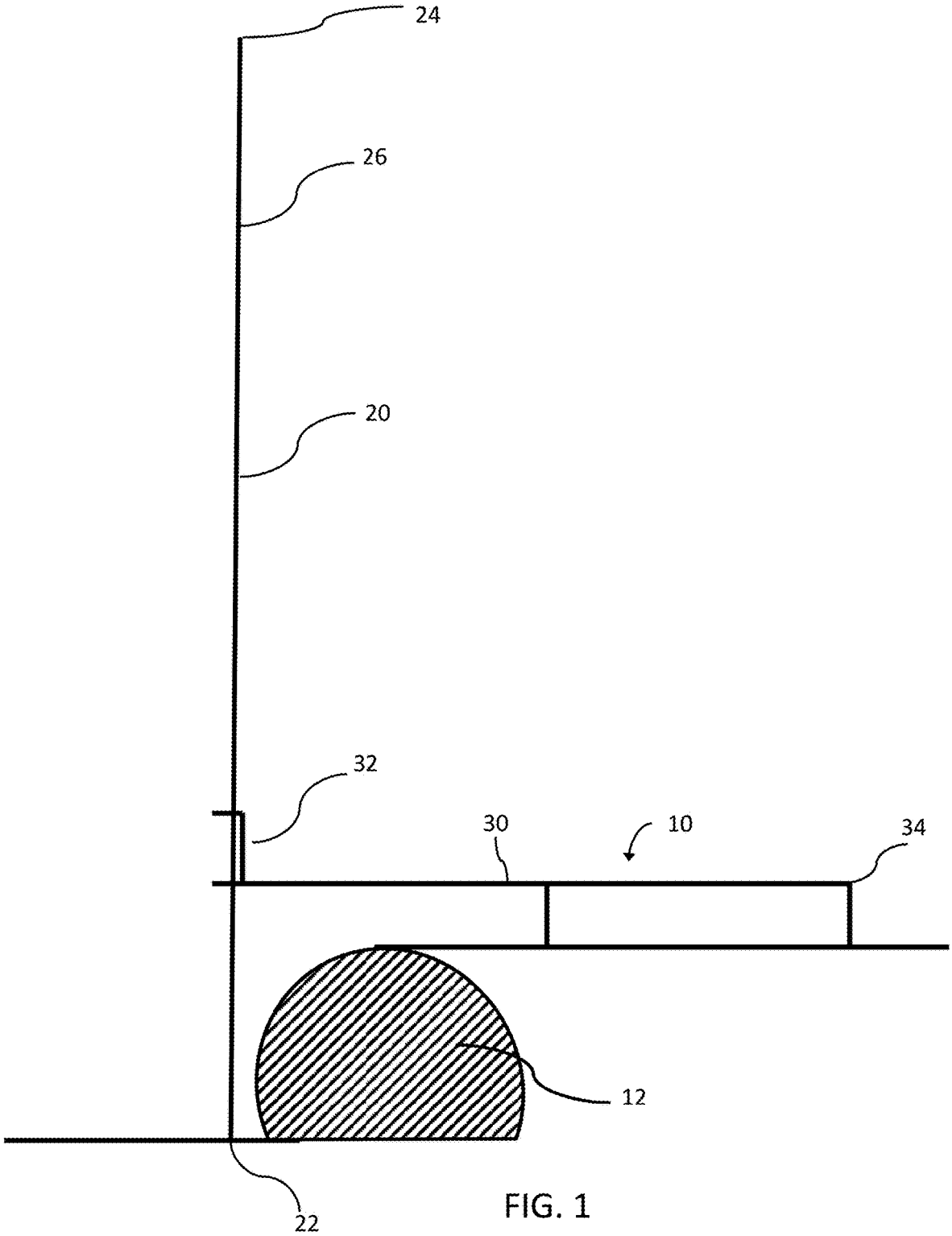
FIG. 1 is a front view of a support anchor in accordance with one embodiment of the present invention wherein a marking pole is received in the support anchor and the support anchor has been inserted into the ground adjacent to the curb.

In reference to FIGS. 1-3B, a support anchor 10 in accordance with the present invention is shown. The support anchor 10 includes a shaft member 30 extending along an axis between a first end 32 and a second end 34. The shaft member 30 includes an intermediate portion between the first end 32 and the second end 34. In the embodiment shown in FIG. 1-3B, the shaft member 30 is rigid. It should be understood that in some embodiments of the present invention, the shaft member is semi-rigid such that it can be bent or flexed by hand or by machine to alter the configuration of the shaft member and that shaft member then retains the new configuration. It should also be understood to a person of ordinary skill in the art and familiar with the invention that although the embodiment disclosed herein illustrates the shaft member extending between a first end 32 and a second end 34 along a linear axis, the present invention is not limited in this regard. For example, in some embodiments of the present invention the shaft member extends between a first end to a second end and includes one or more intermediate configurations such as curves, bends or the like, disposed thereon.

The support anchor 10 includes a first anchor 38 extending radially from the shaft member 30 from an area of the shaft member at or proximate to the second end 34. The first anchor 38 is rigid in the embodiment disclosed in here.

The support anchor 10 includes a second anchor 36 extending radially from the shaft member 30 from an area of the shaft member between the first end 32 and the second end 36 of the shaft member 30. In the embodiment shown in FIG. 3A, the first anchor 38 and the second anchor 36 are generally parallel and are perpendicular to shaft member axis. This configuration facilitates insertion of the anchor members 36, 38 into the ground. A person of ordinary skill in the art and familiar with this disclosure will understand that the angle the anchor members and shaft members shaft member axis may vary. Likewise, an angle of the first anchor 38 relative to the second anchor 36 may vary.

In some embodiments, the first anchor 38 and the second anchor 36 may be integrally formed with the shaft member 30. In other embodiments, the first anchor 38 and the second anchor 36 may be formed separately and connected to the shaft member 30 via releasable means, such as threaded fasteners or by fix means, such as welding or the like. In yet other embodiments, different anchor configurations are possible. For example, in one embodiment of the present invention a tripod configuration of three anchor members is used to secure the support into the ground. The length of the first and second anchor 36 and 38 may vary. In some embodiments of the present invention, the length of the support anchors is between 6 inches and 1 foot. Although it should be understood that the length may vary. In some embodiments of the present invention, the support anchors include pointed distal ends 37, 38, 137, 138 to facilitate insertion into the ground. This is particularly useful in climates where the ground is hard or frozen.

The shaft member 30 further includes a cantilevered section extending along the shaft member axis between the first end 32 and the intersection of the second anchor 36 and the shaft member 30. In the embodiment shown in FIG. 3, the length of the cantilevered section is selected so that it is equal to or greater than the width of a standard curb. It will be understood by a person of ordinary skill in the art and familiar with this disclosure that the length of the cantilevered section may vary depending the type of curb and intended use of the anchor support.

Figure 3A:
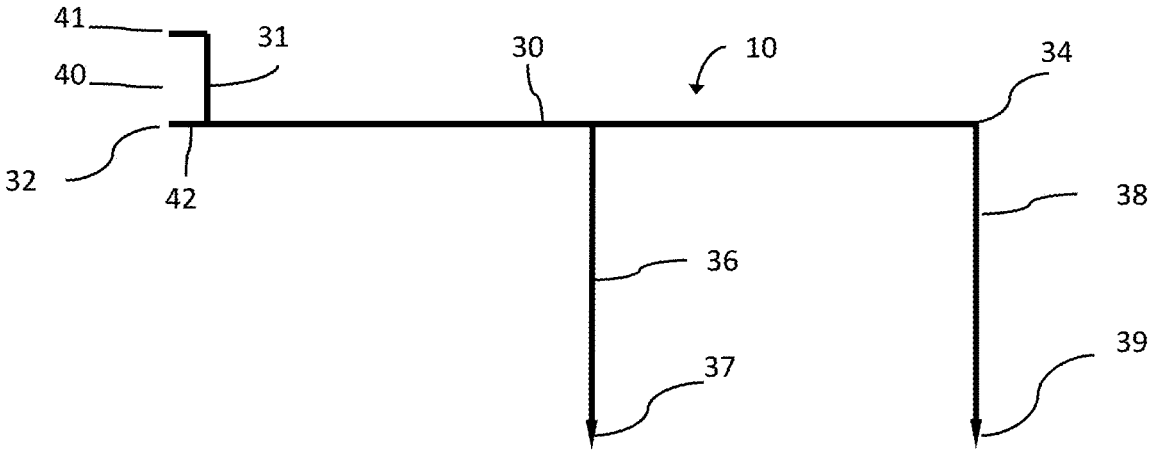
FIG. 3A is a front view of the support anchor.
Figure 3B:
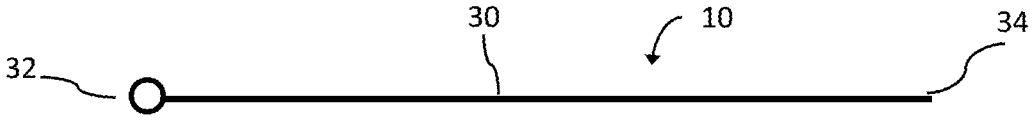
FIG. 3B is a top view of the support anchor shown in FIG. 3A.

In reference to FIGS. 3A and 3B, the shaft member 30 includes a receiver 40 at the first end 32 of the shaft member 30. The receiver 40 is configured to receive a marking pole 20. In the embodiment disclosed, the receiver comprises a first 41 and second 42 openings configured to receive the marking pole 20. In the disclosed embodiment the, the first opening 41 and the second opening 42 are coaxial so as to receive the marking pole 41 in substantially vertical orientation. An inner diameter of the first opening 41 and an inner diameter of the second opening 42 are greater than an outside diameter or dimension of the marking pole 20 such that the openings 41, 42 can slideably receive the marking pole 20. In some embodiments of the present invention, the first opening 41 and the second opening 41 are off set so as to retain the marking pole 20 at angle relative to the driving surface, thereby identifying the edge of a driving surface while providing additional clearance above the driving surface to allow for passage of side-view mirrors and the like that are outside the footprint of the driving surface. The receiver includes a support element 31 extending radially from the shaft member 30 that connects and separates the first opening 41 and the second opening. In the embodiment disclosed, the length of the support element is selected so as to provide sufficient distance between the first opening 41 and the second opening 41 so as to adequately support the marking pole 20 in position.

Figure 2:
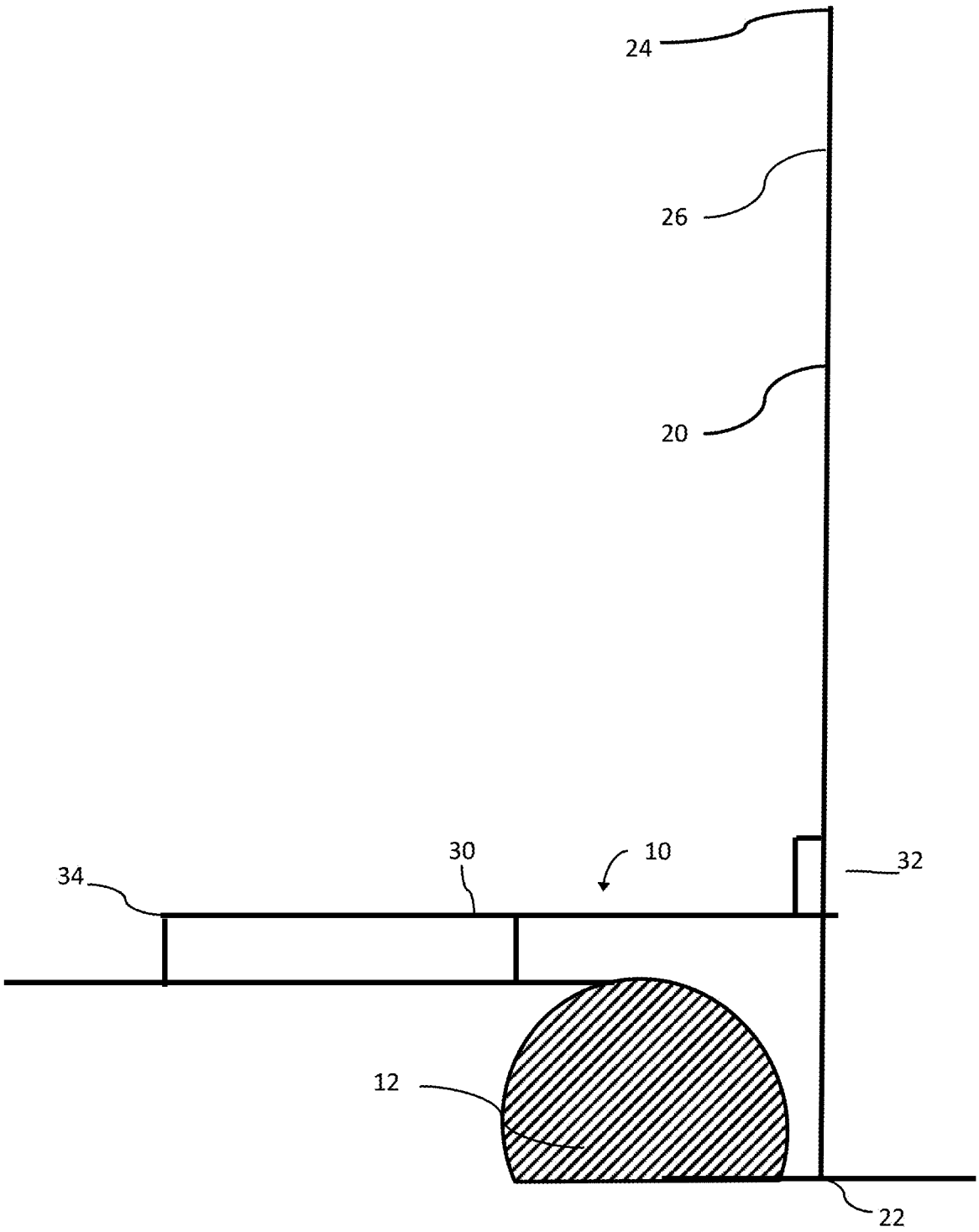
FIG. 2 is a rear view of the support anchor shown in FIG. 1.

In reference to FIGS. 1 and 2, an embodiment of a marking pole 20 in accordance with the present invention is disclosed. The marking pole 20 extends along a longitudinal axis between a first end 22 and a second end 24 and defines an intermediate section between the first end 22 and the second end 24. In the embodiment disclosed, the marking pole 20 has a circular cross section in a plane perpendicular to the longitudinal axis of the marking pole 20. The marking pole 20 includes one or more reflectors 26 positioned proximate to the second end 24 of the marking pole 20. The reflectors may comprise reflective tape or paint that is applied to the pole 20. In other embodiments, such as those shown in FIGS. 5A-5C, the reflectors are separate structures that are affixed to the pole 20.

The anchor support 10 is shown in an installed configuration in FIGS. 1 and 2. The anchor support 10 is installed at a border edge between driving surface and grass area. In the embodiment shown, a raised curb 12 separates the driving surface and the adjacent grass area. Curbs and similar features are known in the art to enhance fluid flow on the driving surface and to inhibit undesired fluid flow into the grass area. Such features may also be aesthetic.

The first anchor 38 and the second anchor 36 are inserted into the ground adjacent to the curb 12 thereby fixing the position of the support anchor 10 relative to the ground. It is possible to insert the anchors members 36, 38 into the ground by applying pressure to a top surface of the shaft member 30 between the two anchors 36, 38 by, for example, a foot or a hammer. The cantilevered section of the shaft member 30 extends over the curb 12 so that receiver 40 at the first end 32 of the shaft member 30 is positioned just inside a lower edge of the curb 12 being directly adjacent to the driving surface. The marking pole 20 is received by the receiver 41. In the embodiment disclosed, the first end of the marking pole 22 rests on the driving surface proximate to the curb 12. The marking pole 20 extends upward and is generally perpendicular to the driving surface. The marking pole 20 delineates the true edge of the driving surface. In this manner, it is possible to readily identify the edge of the driving surface when the ground is covered by snow, darkness, leaves or the like.

During use, the anchor support 10 is repeatedly subjected to large loads of snow pushed at marker 10 during plowing. The inventor has discovered that by providing a shaft member 30 having at least two anchor members 36, 38 inserted into the grass area it is possible to fixedly retain the marking pole 20 in position during the duration of the winter season. The dual anchor system ensures that the anchor support 10 remains fixed in position despite these forces. By employing multiple anchors members, rotation of the anchor support is inhibited. Thereby ensuring the most accurate identification of the edge of the driving surface through the winter season and inhibiting any resultant plow damage.

As discussed above, the length of the cantilevered section is selected so that it is greater than or equal to the standard width of a curb. In this manner, it is possible to delineate the driving surface edge via a vertically displayed marking pole. The position of the marking pole can be adjusted based on the insertion point of the first and second anchor members into the ground. For example, when the cantilevered section has a length greater than the width of the curb at the installation site, the anchor members can be inserted a distance away from the curb edge to ensure that marking pole accurately identifies the edge of the driving surface. In this manner, an anchor support 30 can be manufactured in a single size and accommodate a number of different sized curbs or edge configurations.

In the embodiment disclosed, the shaft member 30 and radially extending anchor members 36, 38 are manufactured from metal and bent into shape by machine or other tools during the manufacturing process so that the members retain the desired position. It will be understood to a person of ordinary skill in the art and familiar with this disclosure that different methods for manufacture may be employed.

Figure 4:
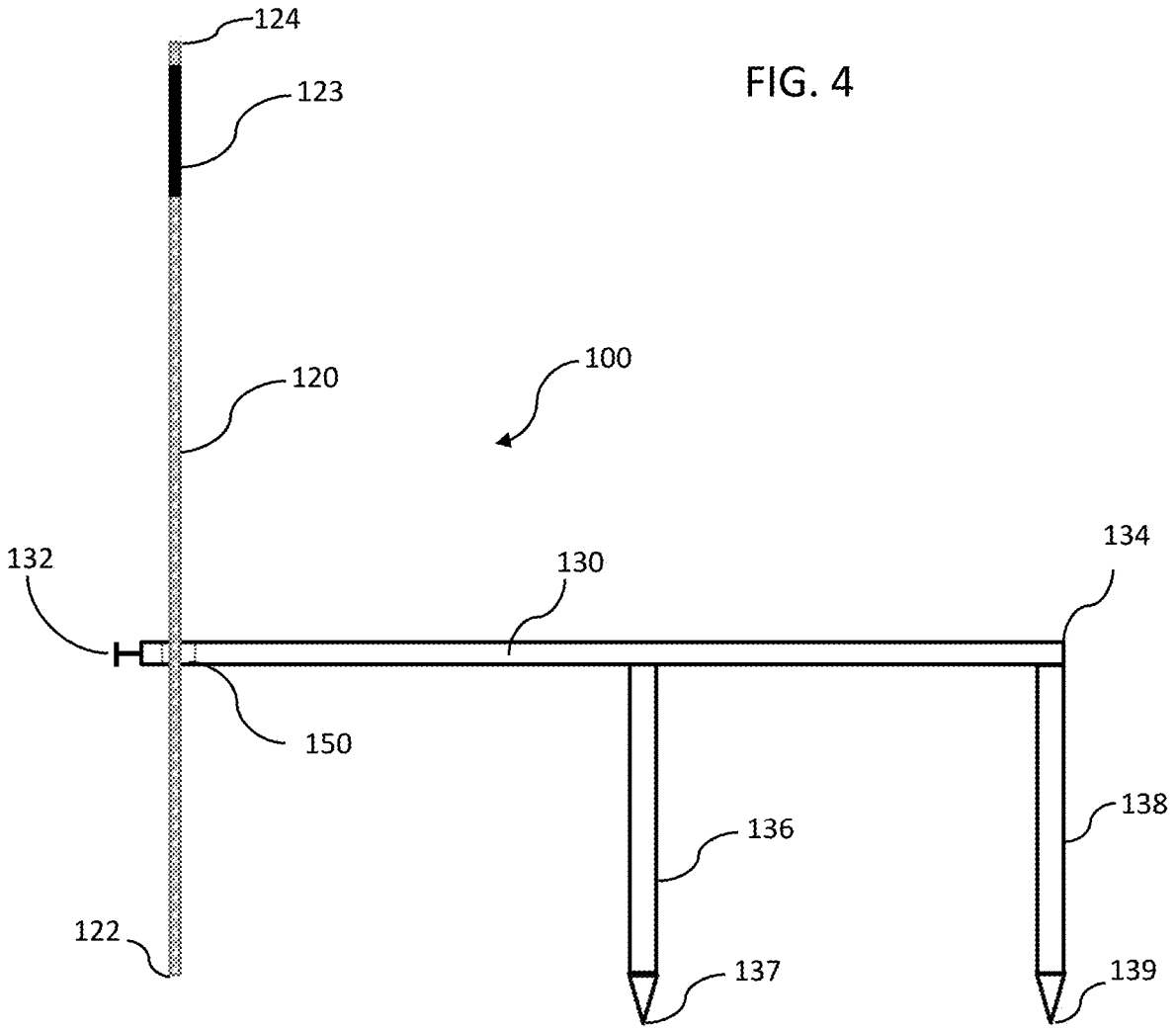
FIG. 4 is a front view of a support anchor in accordance with one embodiment of the present invention wherein a marking pole has been received in the support anchor.

In reference to FIG. 4 another embodiment of the present invention is shown wherein the shaft member 130 is manufactured from steel sections that are welded together. The support anchor 110 includes a shaft member 130 extending along an axis between a first end 132 and a second end 134. The shaft member 130 includes an intermediate portion between the first end 132 and the second end 134. The shaft member 30 is rigid. The support anchor 110 includes a first anchor 138 extending radially from the shaft member 130 from an area of the shaft member proximate to the second end 134. The support anchor 110 includes a second anchor 136 extending radially from the shaft member 130 from an area of the shaft member between the first end 132 and the second end 136 of the shaft member 130.

The shaft member 130 further includes a cantilevered section extending along the shaft member axis between the first end 132 and the intersection of the second anchor 136 and the shaft member 130. In the embodiment shown in FIG. 4, the length of the cantilevered section is selected such that it is equal to or greater than the width of a standard curb. The shaft member 130 includes a receiver at the first end 132 of the shaft member 130. The receiver is configured to receive a marking pole. In the embodiment disclosed, the receiver comprises a single opening 150 to receive the pole and includes a screw mechanism 132 to fix the pole relative to receiver.

The support anchor 10, 110 can be manufactured from any known material including steel, fiberglass, plastic, PVC, and other materials. It should be further noted that the marking pole 20, 120 can be connected via a number of different mechanisms, including receiving holes as disclosed in FIG. 3 and a receiving bore as disclosed in FIG. 4 with an accompanying screw for fixing the position of the marking pole. In yet further embodiments of the present invention the marking pole is integrally formed with the anchor support.

Figure 5A:
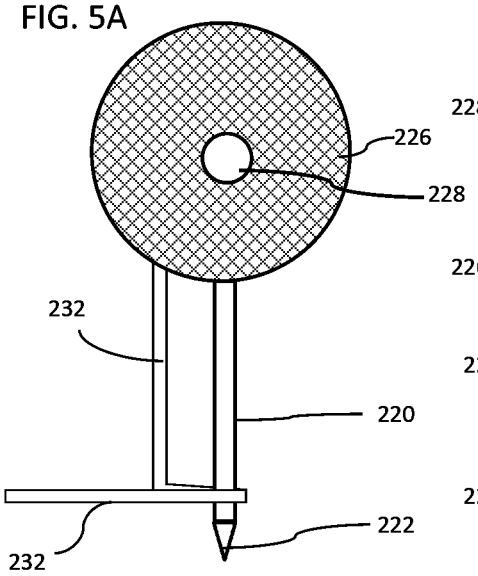
FIG. 5A is a rear view of a portion of a support anchor in accordance with one embodiment of the present invention wherein a marking pole has been received in the support anchor.
Figure 5B:
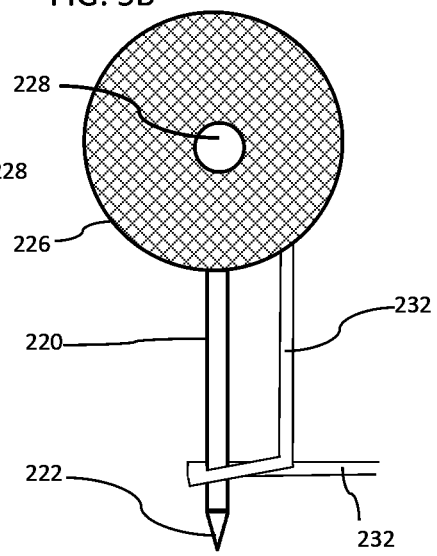
FIG. 5B is a front view of the portion of the support anchor shown in FIG. 5A.
Figure 5C:
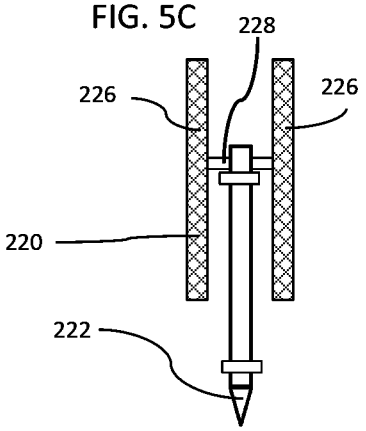
FIG. 5C is a side view of the portion of the support anchor shown in FIG. 5A

In reference to FIG. 5A-5C, another embodiment of the present invention is shown wherein an embodiment of the marking pole 220 in accordance with the present invention is disclosed. In this embodiment, the marking pole 220 is received in the receiver but does not rest on the ground. The marking pole 220 extends along a longitudinal axis between a first end 222 and a second end 224 and defines an intermediate section between the first end 22 and the second end 224. In the embodiment disclosed, the marking pole 220 has a circular cross section in a plane perpendicular to the longitudinal axis of the marking pole 220. The marking pole 20 includes one or more reflectors 226 positioned proximate to the second end 224 of the marking pole 220. In some embodiments, the reflectors 226 can be one or more circular reflectors positioned proximate to the second end 224 of the marking pole 220. In some further embodiments the reflectors are fastened to the marking pole 220 by a fastener 228 that has two removable reflectors. In the embodiment disclosed, the reflectors 226 are connected via a support that passes transversely through an opening in the marker pole. In this embodiment, the fastener is placed through a hole situated proximate to the second end 224 of the marking pole 220. The marking pole 220 extends upward and is generally perpendicular to the driving surface. The marking pole delineates the true edge of the driving surface. In this manner, it is possible to plow the driving surface without hitting or damaging the curb.

The present disclosure describes aspects of the present invention with reference to the above-described embodiments; however, aspects of the present invention are not limited to those embodiments. It will be apparent to those of ordinary skill in the art that aspects of the present invention include many more embodiments. Accordingly, aspects of the present invention are not to be restricted in light of the above-described embodiments. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

It should be apparent from the foregoing detailed description that the objects set forth hereinabove have been successfully achieved. Moreover, while there is shown and described present preferred embodiments of the invention it is to be distinctly understood that the invention is not limited thereto but may be otherwise variously embodied and practiced within the scope of the following claims

What is claimed is:

1. A support anchor for positioning a marking pole relative to a driving surface the support comprising:

a shaft member extending along a shaft member axis between a first end and a second end and having an intermediate portion between the first end and the second end;

a first anchor extending along a first anchor axis from an area of the shaft member at or proximate to the second end of the shaft member to a distal point of the first anchor, the first anchor axis being perpendicular to the shaft member axis;

a second anchor extending along a second anchor axis from an area of the shaft member proximate to the intermediate portion to a distal point of the second anchor, the second axis being parallel to the first anchor axis and being perpendicular to the shaft member;

wherein the first anchor and the second anchor extend radially from the shaft member in a same direction so as to facilitate insertion of the first anchor and the second anchor in to a ground surface and wherein the first anchor and the second anchor are substantially a same length;

the shaft member including a cantilevered section between the first end of the shaft member and an intersection of the second anchor and shaft member, the cantilevered section extending along the shaft member axis, the cantilevered section causing the first end of the shaft member to be remote from the anchors;

a receiver at the first end of the shaft member, the receiver configured to receive a marking pole; the receiver comprising a first opening and a second opening, the first opening at or proximate to the first end of the shaft member, the second opening attached to a spacer extending along a spacer axis that is perpendicular to the shaft member axis and parallel to the first anchor axis and to the second anchor axis;

wherein the first opening is coaxial with the second opening so that when a marking pole having a marking pole axis is simultaneously received through the first and through the second opening, the marking pole is parallel to the spacer axis and to the first anchor axis and to the second anchor axis.

2. The support anchor of claim 1 wherein the shaft member is rigid.

3. The support anchor of claim 1, further comprising a marking pole received in the receiver.

4. The support anchor of claim 3, wherein the marking pole further comprises a reflector affixed thereto.

5. The support anchor of claim 1, wherein the distal end of the first anchor and the distal end of the second anchor each forms a point.

6. The support anchor of claim 1, wherein the first opening is defined by a first metal ring and the second opening is defined by a second metal ring and wherein the first metal ring is separated from the second metal ring by a length of the spacer.

* * * * *